United States Patent [19]

Yaguchi et al.

[11] Patent Number: 4,895,828

[45] Date of Patent: Jan. 23, 1990

[54] THERMOSENSITIVE RECORDING MATERIAL

[75] Inventors: Hiroshi Yaguchi; Hisashi Sakai, both of Numazu, Japan

[73] Assignee: Ricoh Company, Ltd., Tokyo, Japan

[21] Appl. No.: 350,203

[22] Filed: May 11, 1989

[30] Foreign Application Priority Data

May 19, 1988 [JP] Japan ..... 63-122273

[51] Int. Cl.[4] ..... B41M 5/18; B41M 5/20

[52] U.S. Cl. ..... 503/226; 427/152; 428/913; 428/914; 503/200; 503/207; 503/226

[58] Field of Search ..... 427/150–152; 428/913, 914; 503/200, 207, 226

[56] References Cited

U.S. PATENT DOCUMENTS 4,132,436 1/1979 Ishige et al. ..... 428/913

*Primary Examiner*—Pamela R. Schwartz

*Attorney, Agent, or Firm*—Oblon, Spivak, McClelland, Maier & Neustadt

[57] ABSTRACT

A thermosensitive recording material is disclosed, which comprises a support, an intermediate layer comprising an expanded plastic filler, formed on the support, and a thermosensitive coloring layer formed on the intermediate layer, in which an electroconductive agent is contained in an effective amount in at least one of the intermediate layer or the thermosensitive coloring layer.

18 Claims, No Drawings

THERMOSENSITIVE RECORDING MATERIAL

BACKGROUND OF THE INVENTION

1. Field of the Invention

The present invention relates to a thermosensitive recording material, and more particularly to an improved thermosensitive recording material comprising a support, an intermediate layer comprising an expanded plastic filler with minute voids prepared by expanding an expandable plastic filler, formed on the support, and a thermosensitive coloring layer formed on the intermediate layer, with an electroconductive agent being contained in at least one of the intermediate layer or the thermosensitive coloring layer.

2. Discussion of Background

It is conventionally known that a colorless or light-colored coloring leuco dye reacts with a color developer such as an organic acidic material to be colored upon application of heat thereto when the leuco dye and the color developer are fused. Thermosensitive recording materials utilizing this coloring reaction are conventionally known as are disclosed, for instance, in Japanese Patent Publication Nos. 43-4160 and 45-14039.

Recently, these thermosensitive recording sheets have been employed in a variety of fields, for instance, for use with recorders for measurement instruments, terminal printers for computers, facsimile apparatus, automatic ticket vending apparatus, and bar code readers.

In accordance with recent remarkable improvements in the application of the above-mentioned recording apparatus to a variety of new fields and in the performance thereof, there is a great demand for thermosensitive recording sheets which can complement those improved apparatus. More specifically, there are demanded thermosensitive recording sheets capable of yielding sharp images with high density with application of a small amount of thermal energy with the increase in the thermal head speed. In addition, thermosensitive recording sheets are required to satisfy the sufficient thermal head matching properties such as not forming any dust from the recording material in the course of thermosensitive recording by use of the thermal head which comes into contact with the surface of the thermosensitive recording material and not sticking to the thermal head.

Color development on the thermosensitive recording sheet can be attained by the melting of a coloring leuco dye or a color developer or both of them and the successive reaction of the two to induce a color in the leuco dye under the application of thermal energy from the thermal head.

As a method of increasing the thermal coloring sensitivity of the thermosensitive recording material, there is widely known a method of adding to the thermosensitive recording material a thermofusible material which melts at a temperature lower than the melting points of the employed leuco dye and the color developer and is capable of dissolving herein the leuco dye and color developer when melted.

A variety of such thermofusible materials for use in this method has been proposed, for example, nitrogen-containing compounds such as acetamide, stearamide, m-nitroaniline, and phthalic acid dinitrile in Japanese Laid-Open Patent Application No. 49-34842; acetoacetic anilide in Japanese Laid-Open Patent Application No. 52-106746; and alkylated biphenyl alkanes in Japanese Laid-Open Patent No. Application 53-39139.

However, in accordance with the recent development of a high speed thermal facsimile apparatus, it has become a common practice to energize and drive a thermal head at high speed. Under such circumstances, there is the problem that the background of a thermosensitive recording sheet is also colored due to the build-up of thermal energy in the thermal head and therearound in the course of repetition of high speed thermosensitive recording. In order to solve this problem, it is one of the most important subjects to be cleared to enhance the dynamic thermal coloring sensitivity of the conventional thermosensitive recording material, without decreasing the coloring initiation temperature thereof. In the conventional thermosensitive recording materials the dynamic thermal coloring sensitivity cannot be increased unless a large amount of the above-mentioned thermofusible compounds is added, although the static thermal coloring sensitivity can be increased to some extent by the addition of the thermofusible compounds. However, when a large amount of the thermofusible materials is employed, the sticking and dust-adhesion problems occur in the course of thermal recording by a thermal head. Further, when the melting points of the employed thermofusible compounds are extremely low, the preservability of the thermosensitive recording sheets is significantly degraded so that the fogging of the background of the recording material occurs during the storage thereof.

For the purpose of increasing the dynamic thermal coloring sensitivity of the recording material, there have been proposed a method of smoothing the surface of the thermosensitive coloring layer, and a method of increasing the concentration of the coloring components by decreasing the relative amounts of components which do not contribute to the coloring reaction of the thermosensitive recording material, such as fillers and binder agents.

The method of smoothing the surface of the thermosensitive coloring layer is usually carried out without difficulty by use of a supercalender. However, this method has the shortcomings that the background of the thermosensitive coloring layer is colored during the calendering process and the surface of the thermosensitive coloring layer becomes so glossy that the appearance of the recording material is impaired.

Fillers such as calcium carbonate, clay, and urea-formaldehyde resin may be added to the thermosensitive coloring layer to maintain the whiteness of the background of the coloring layer and to prevent the sticking and dust adhesion problems during the thermosensitive recording using a thermal head. Further a water-soluble binder agent may be added to the thermosensitive coloring layer to firmly bind the coloring components and other additives of the thermosensitive coloring layer to the support. When the amounts of such a filler and a water-soluble binder agent are reduced, the desired properties for the thermosensitive recording material cannot be obtained.

In addition, there have been proposed thermosensitive recording materials, in which an intermediate layer with a sufficient heat insulating properties, including a foamed portion with minute voids, is interposed between a support and a thermosensitive coloring layer. For example, a thermosensitive recording material in which an intermediate layer comprising as the main component microballoon particles is interposed between a support and a thermosensitive coloring layer is proposed in Japanese Laid-Open Patent Application No. 59-5093; and a thermosensitive recording material comprising a support, an intermediate layer A comprising an expanded plastic filler prepared by expanding an expandable plastic filler formed on the support, an intermediate layer B comprising a filler and a binder agent formed on the intermediate layer B, and a thermosensitive coloring layer formed on the intermediate layer B is proposed in Japanese Laid-Open Patent Application No. 59-225987.

To prepare the intermediate layer including the expanded plastic filler with minute voids, a method of coating on the support a liquid comprising an expandable plastic filler in an unexpanded state and then expanding the expandable plastic filler under application of heat thereto is generally used. However, this method has the shortcomings that the surface of the obtained intermediate layer becomes uneven after heated, and the obtained images lack surface uniformity.

As a solution to the above-mentioned problem, in the thermosensitive recording material as disclosed in the above-mentioned Japanese Laid-Open Patent Application No. 59-225987, the intermediate layer A which includes the expanded filler is covered with the intermediate layer B, so that the surface of the intermediate layer A is made smooth. Alternatively, a method of subjecting the intermediate layer to calendering can be used to improve the surface smoothness thereof.

However, in spite of the above-mentioned countermeasure, it has become obvious that such intermediate layers including expanded plastic fillers with minute voids have a serious problem with respect to static electricity when industrially mass-produced. More specifically, the expandable plastic filler, in the expanded state, contained in the intermediate layer not only has high electrical resistance by itself, but also can be easily electrostatically charged by slight friction because the water content in the intermediate layer is significantly reduced in the course of heating process. Therefore, during the manufacturing operation of a large amount of the thermosensitive recording sheets comprising an intermediate layer including the expanded plastic filler with minute voids, the intermediate layer is disadvantageously attached to the surface of the transportation rollers due to its electrostatic charge, especially when a liquid for the formation of the intermediate layer is coated on the support and the intermediate layer is subjected to calendering. Further, when these semi-fabricated recording sheets in which the intermediate layer is formed on the support are wound around a winder or unwound off an unwinder, sparking is apt to occur due to the electrical discharge of the recording sheets, so that it is quite difficult to manufacture high-quality products steadily and safely.

Even though the conventional thermosensitive recording sheets are completed by coating the thermosensitive coloring layer on the above-mentioned intermediate layer, they are easily electrostatically charged, so that they cannot always be smoothly carried in the thermal printing apparatus for practical use.

SUMMARY OF THE INVENTION

It is therefore an object of the present invention to provide a thermosensitive recording material having high dynamic thermal coloring sensitivity, which can be easily and steadily produced and hardly causes troubles in the course of the practical thermal printing operation, especially, while carried in a thermal printing apparatus.

The above object of the present invention can be achieved by a thermosensitive recording material comprising a support, an intermediate layer comprising an expanded plastic filler with minute voids prepared by expanding an expandable plastic filler, formed on the support, and a thermosensitive coloring layer formed on the intermediate layer, with an electroconductive agent being contained in at least one of the intermediate layer or the thermosensitive coloring layer.

DETAILED DESCRIPTION OF THE PREFERRED EMBODIMENTS

The thermosensitive recording material according to the present invention is constructed in such a manner that an intermediate layer comprising an expanded plastic filler is interposed between a support and a thermosensitive coloring layer. Furthermore, at least one of the above-mentioned intermediate layer or the thermosensitive coloring layer of the thermosensitive recording material according to the present invention comprises an electroconductive agent.

According to the present invention, the intermediate layer may be constructed by combining a first intermediate layer comprising an expanded plastic filler and a second intermediate layer comprising as the main components an organic and/or inorganic filler and a water-soluble polymeric resin and/or a water-based emulsion type resin, as will be described in detail. In the case where the second intermediate layer is laminated on the first intermediate layer, the electroconductive agent is contained in at least one of the thermosensitive coloring layer, the first intermediate layer and the second intermediate layer.

The thermosensitive recording material according to the present invention has high dynamic thermal coloring sensitivity, and at the same time, it substantially causes no troubles due to the electrostatic charge of the recording material when manufactured, and used in the thermal printing apparatus.

More specifically, the intermediate layer of the thermosensitive recording material according to the present invention comprises the expanded plastic filler with minute voids, having a low density, and a low thermal conductivity, so that the intermediate layer can function as a heat insulating layer as a whole. By this effect of the intermediate layer comprising the expanded plastic filler, the thermal energy for thermal printing, provided by a thermal head, can be effectively utilized in the thermosensitive coloring layer of the recording material. Thus, the thermosensitive recording material according to the present invention has high dynamic thermal coloring sensitivity.

Furthermore, in the thermosensitive recording material according to the present invention, an electroconductive agent is contained in at least one of the intermediate layer or the thermosensitive coloring layer. The electrical resistance of the thermosensitive recording material according to the present invention is reduced and the troubles caused by the electrostatic charge of the recording material can be avoided in the manufacturing operation and in the practical thermal printing operation in the thermal printing apparatus.

In the present invention, the expanded plastic filler for use in the intermediate layer is prepared by expanding an expandable plastic filler with application of heat thereto. As such expandable plastic fillers, a variety of conventionally known materials in the field of the conventional thermosensitive recording materials can be employed.

The expandable plastic filler for use in the present invention is a plastic filler having minute voids therein, which comprises a thermoplastic material serving as a shell and a low boiling point solvent contained in the shell, which expandable plastic filler ca be expanded under application of heat thereto.

It is preferable that the particle diameter of the expandable plastic filler be in the range of 2 to 50 μm, more preferably in the range of 5 to 20 μm in the unexpanded state thereof. It is preferable that the particle diameter of the expandable plastic filler be in the range of 10 to 100 μm, more preferably in the range of 10 to 50 μm in the expanded state thereof.

Specific examples of the thermoplastic resin for the shell of this plastic filler include polystyrene, polyvinyl chloride, polyvinylidene chloride, polyvinyl acetate, polyacrylic acid ester, polyacrylonitrile, polybutadiene and copolymers of the above. As the blowing (expanding) agent placed in the shell, propane and butane can be generally employed.

The intermediate layer including the expanded plastic filler with minute voids for use in the present invention can be basically prepared by the conventional method of dispersing an expandable plastic filler in an unexpanded state and a binder, coating the above dispersion on the support, and then expanding the expandable plastic filler with application of heat thereto. In this case, any heating method is applicable if the thermoplastic material serving as a shell of the plastic filler is heated sufficiently enough to show its plasticity. From the viewpoint of industrial production efficiency, the following methods are preferable because the thermosensitive recording materials can be continuously manufactured.

(1) A heating method by causing the intermediate layer of the thermosensitive recording material to pass through the inside of a heated box, and when necessary, by blowing heated air or irradiating infrared rays to the surface of the intermediate layer when necessary.
(2) A heating method by bringing a heating plate or drum into contact with the intermediate layer.
(3) A combined method of the above (1) and (2).

The above intermediate layer prepared by expanding the expandable plastic filler under application of heat thereto has the shortcoming that it is easily electrostatically charged as mentioned previously, so that it must be handled with the utmost care. This shortcoming of the intermediate layer cannot be removed even when the thermosensitive coloring layer is coated on the intermediate layer.

According to the present invention, an electroconductive agent is added to the thermosensitive recording material to solve the above-mentioned problem. A significant effect can be achieved by adding the electroconductive agent to any of the intermediate layer and the thermosensitive coloring layer.

In the case where the intermediate layer is prepared by expanding the expandable plastic filler under application of heat thereto and subjected to calendering to smoothen the surface thereof, the electroconductive agent is preferably added to the intermediate layer. This is because the trouble due to the electrostatically charged intermediate layer can be prevented in the course of the calendering process if the electroconductive agent for use in the present invention is added to the intermediate layer. In the course of the calendering process, the intermediate layer is allowed to pass through the pressure application roller, so that significant frictional force is, in principle, applied to the surface of the intermediate layer. In addition, when the expanded plastic filler contained in the intermediate layer is pressed by the pressure application rollers to make the surface thereof rather smooth, the surface of the intermediate layer is apt to come into close contact with the pressure application roller. Each time the intermediate layer is brought into contact with the pressure application roller and then peeled off the same in the course of the calendering process, the intermediate layer is easily electrostatically charged and accordingly easily attached to the surface of the transportation rollers or wound around the winder. Thus, there is the risk that the static electricity is built up and sparking is apt to take place. To remedy the above trouble, the electroconductive agent may be preferably added to the intermediate layer of the thermosensitive recording material.

As mentioned previously, according to the present invention, the intermediate layer may be constructed by combining a first intermediate layer comprising an expanded plastic filler and a second intermediate layer comprising as the main components an organic and/or inorganic filler and a water-soluble polymeric resin and/or a water-based emulsion type resin. In the case where the second intermediate layer is laminated on the first intermediate layer, the suitability for overlaying the thermosensitive coloring layer thereon can be improved and the thermal head matching properties of the thermosensitive recording material in a thermal printing apparatus can also be improved. In this case, the trouble as caused by the electrostatic charging of the intermediate layer can be eliminated by adding the electroconductive agent to at least one layer of the first intermediate layer, the second intermediate layer or the thermosensitive coloring layer, prior to the calendering process.

As the electroconductive agent for use in the present invention, conventionally known electroconductive agents can be employed. Specific examples are as follows:

(a) Inorganic salts such as sodium chloride, potassium chloride, magnesium chloride, ammonium chloride, lithium chloride, aluminum chloride, zinc chloride, potassium bromide, zinc bromide, zinc phosphate, and zinc acetate.
(b) Organic salts such as potassium formate and sodium oxalate.
(c) Electroconductive metallic oxides such as zinc oxide and tin oxide.
(d) Nonionic antistatic agents such as polyoxyethylene alkylamine, polyoxyethylene alkylamide, polyoxyethylene alkyl ether, polyoxyethylene alkyl phenyl ether, glycerol fatty acid ester, and sorbitan fatty acid ester.
(e) Anionic antistatic agents such as alkylsulfonate, alkylbenzenesulfonate, alkylsulfate, alkyl phosphate, polyacrylic acid salt, polymethylacrylate salt and polystyrene sulfonate.
(d) Cationic antistatic agents such as quaternary ammonium chloride, quaternary ammonium sulfate, quaternary ammonium nitrate and methylpyridinium salt.
(e) Amphoteric antistatic agents such as alkyl betaine, alkyl imidazoline and alkyl alanine.

(f) Polymeric antistatic agents such as polyvinyl benzyl type cation, polyacrylic acid type cation and polystyrene type cation.

The above-mentioned electroconductive agent can be employed alone or in combination.

It is preferable that the amount ratio of the electroconductive agent to the entire solid components of each layer which contains the electroconductive agent therein be 10% or less, more preferably about 1%.

According to the present invention, a binder agent for use in the intermediate layer may be selected from the conventional water-soluble polymeric resins and/or water-based emulsion type resins.

Examples of water-soluble polymeric resins are polyvinyl alcohol, starch, starch derivatives, cellulose derivatives such as hydroxymethylcellulose, hydroxyethylcellulose, carboxymethylcellulose, methylcellulose, and ethylcellulose, and other water-soluble polymers such as sodium polyacrylate, polyvinyl pyrrolidone, acrylamide-acrylic acid ester copolymer, acrylamide-acrylic acid ester-methacrylic acid terpolymer, alkali salts of styrene-maleic anhydride copolymer, alkali salts of isobutylene-maleic anhydride copolymer, polyacrylamide, sodium alginate, gelatin and casein.

Examples of water-based emulsion type resins are emulsions of styrene-butadiene copolymer latex, styrene-butadiene-acrylic copolymer latex, vinyl acetate resin, vinyl acetate-acrylic acid copolymer, styrene-acrylic acid ester copolymer, acrylic acid ester resin, and polyurethane resin.

When the intermediate layer is constructed in such a manner that the first intermediate layer comprising the expanded plastic filler and the second intermediate layer comprising as the main components the organic and/or inorganic filler and the water-soluble polymeric resin and/or the water-based emulsion type resin are successively overlaid on the support in this order, the first intermediate layer is first formed on the support and then the second intermediate layer is then formed on the first intermediate layer.

Specific examples of the inorganic filler for use in the second intermediate layer are finely-divided particles of calcium carbonate, silica, zinc oxide, titanium oxide, aluminum hydroxide, zinc hydroxide, barium sulfate, clay, talc, surface-treated calcium, and surface-treated silica. Examples of the organic filler for the second intermediate layer include finely-divided particles of urea-formaldehyde resin, styrene-methacrylic acid copolymer, and polystyrene resin.

As the water-soluble polymeric resin and the water-based emulsion type resin for the second intermediate layer, the same water-soluble polymeric resins and water-based emulsion type resins as employed in the intermediate layer, as previously mentioned, can be used.

The above-mentioned organic and/or inorganic fillers can be added to the intermediate layer as far as the characteristics of the expandable plastic filler contained therein are not impaired. In the case where the first intermediate layer and the second intermediate layer are formed on the support, as the matter of course, these fillers can also be added to the above-mentioned first intermediate layer as far as the characteristics of the expandable plastic filler contained therein are not impaired.

According to the present invention, the thermosensitive coloring layer is formed on the intermediate layer including an expanded plastic filler with minute voids.

The thermosensitive coloring layer for use in the present invention comprises s the main components a leuco dye and a color developer which reacts with the above leuco dye to be colored when fused upon application of heat thereto.

As the leuco dyes for use in the present invention, which are employed alone or in combination, any conventional leuco dyes for use in conventional thermosensitive materials can be employed. For example, triphenylmethane-type leuco compounds, fluoran-type leuco compounds, phenothiazine-type leuco compounds, auramine-type leuco compounds, spiropyran-type leuco compounds and indolinophthalide-type leuco compounds are preferably employed.

Specific examples of those leuco dyes are as follows:

3,3-bis(p-dimethylaminophenyl)-phthalide,
3,3-bis(p-dimethylaminophenyl)-6-dimethylaminophthalide (or Ctystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]6-diethylaminofluoran,
2-[3,6-bis(diethylamino)-9-(o-chloroanilino)xanthylbenzoic acid lactam],
3-diethylamino-6-methyl-7-(m-trichloromethylanilino)-fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino) fluoran,
Benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-2'-hydroxy-4'-chloro-5'-methylphenyl)phthalide,
3-(N-ethyl-N-isoamyl)amino-6-methyl-7-anilinofluoran,
3-(N-ethyl-N-tetrahydrofurfuryl)amino-6-methyl-7-anilinofluoran,
3-(N-ethyl-N-ethoxypropyl)amino-6-methyl-7-anilinofluoran,
3-(N-methyl-N-isopropyl)amino-6-methyl-7-anilinofluoran,
3-morpholino-7-(N-propyl-trifluoromethylanilino)-fluoran,
3-pyrrolidino-7-trifluoromethylanilinofluoran, 3-diethylamino-5-chloro-7-(N-benzyl-trifluoromethylanilino)fluoran,
3-pyrrolidino-7-(di-p-chlorophenyl)methylamino-fluoran,
3-diethylamino-5-chloro-7-(α-phenylethylamino)-fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylethylamino)-fluoran,
3-diethylamino-7-piperidinofluoran,
2-chloro-3-(N-methyltoluidino)-7-(p-n-butylanilino)-fluoran,
3-(N-benzyl-N-cyclohexylamino)-5,6-benzo-7-α-naphthyl-amino-4'-bromofluoran, and
3-diethylamino-6-methyl-7-mesidino-4',5'-benzofluoran.

As the color developers for use in the present invention, a variety of electron acceptors, capable of reacting with the above leuco dye upon application of heat to induce color formation in the leuco dyes, which are conventionally known, for example, phenolic materials, organic and inorganic acids, and esters and salts thereof can be employed.

Specific examples of such color developers are gallic acid, salicylic acid, 3-isopropyl salicylic acid, 3-cyclohexyl salicylic acid, 3,5-di-tert-butyl salicylic acid, 3,5-di-α-methylbenzyl salicylic acid, 4,4'-isopropylidenediphenol, 4,4'-isopropylidenebis(2-chlorophenol), 4,4'-isopropylidenebis(2,6-dibromophenol), 4,4'-isopropylidenebis (2,6-dichlorophenol), 4,4'-isopropylidenebis(2-methyl-phenol), 4,4'-isopropylidenebis(2,6-dimethylphenol), 4,4'-isopropylidenebis(2-tert-butylphenol), 4,4'-sec-butylidenediphenol, 4,4'-cyclohexylidenebisphenol, 4,4'-cyclohexylidenebis(2-methylphenol), 4-tert-butylphenol, 4-phenylphenol, 4-hydroxy-diphenoxide, α-naphthol, β-naphthol, 3,5-xylenol, thymol, methyl-4-hydroxybenzoate, 4-hydroxyacetophenone, novolak-type phenolic resin, 2,2'-thiobis(4,6-dichlorophenol), catechol, resorcinol, hydroquinone, pyrogallol, phloroglucin, phloroglucinol-carboxylic acid, 4-tert-octylcatechol, 2,2'-methylenebis(4-chlorophenol), 2,2'-methylenebis(4-methyl-6-tert-butylphenol), 2,2'-dihydroxydiphenyl, ethyl p-hydroxybenzoate, propyl p-hydroxybenzoate, butyl p-hydroxybenzoate, benzyl p-hydroxybenzoate, p-chlorobenzyl p-hydroxybenzoate, o-chlorobenzyl p-hydroxybenzoate, p-methylbenzyl p-hydroxybenzoate, n-octyl p-hydroxybenzoate, benzoic acid, zinc salicylate, 1-hydroxy-2-naphthoic acid, 2-hydroxy-6-naphthoic acid, zinc 2-hydroxy-6-naphthoic acid, 4-hydroxy-diphenylsulfone, 4-hydroxy-4'-chlorodiphenyl-sulfone, bis(4-hydroxyphenyl)sulfide, 2-hydroxy-p-toluic acid, zinc 3,5-di-tert-butylsalicylate, tin 3,5-di-tert-butyl-salicylate, tartaric acid, oxalic acid, maleic acid, citric acid, succinic acid, stearic acid, 4-hydroxy-phthalic acid, boric acid, thiourea derivatives, 4-hydroxythiophenol derivatives, bis(4-hydroxyphenyl)acetate, bis(4-hydroxyphenyl)methyl acetate, bis(4-hydroxyphenyl)ethyl acetate, bis(4-hydroxyphenyl)n-propyl acetate, bis(4-hydroxyphenyl) n-butyl acetate, bis(4-hydroxyphenyl)phenyl acetate, bis(4-hydroxyphenyl)benzyl acetate, bis(4-hydroxyphenyl)phenethyl acetate, bis(3-methyl-4-hydroxyphenyl)acetate, bis(3-methyl-4-hydroxyphenyl)methyl acetate, bis(3-methyl-4-hydroxyphenyl)ethyl acetate, bis(3-methyl-4-hydroxyphenyl)n-propyl acetate, 1,7-bis(4-hydroxyphenylthio)3,5-dioxaheptane, 1,5-di(4-hydroxyphenylthio)-3-oxapentane, 4-dimethyl hydroxyphthalate, 4-hydroxy-4'-methoxydiphenyl-sulfone, 4-hydroxy-4'-ethoxydiphenylsulfone, 4-hydroxy-4'-isopropoxydiphenylsulfone, 4-hydroxy-4'-n-propoxydiphenylsulfone, 4-hydroxy-4'-n-butoxydiphenylsulfone, 4-hydroxy-4'-isobutoxydiphenylsulfone, 4-hydroxy-4'-sec-butoxydiphenylsulfone, 4-hydroxy-4'-tert-butoxydiphenylsulfone, 4-hydroxy-4'-benzyloxydiphenylsulfone, 4-hydroxy-4'-phenoxydiphenylsulfone, 4-hydroxy-4'-(m-methylbenzyloxy)diphenylsulfone, 4-hydroxy-4'-(p-methylbenzyloxy)diphenylsulfone, 4-hydroxy-4'-(o-methylbenzyloxy) diphenylsulfone, and 4-hydroxy-4'-(p-chlorobenzyloxy) diphenylsulfone.

In the present invention, a variety of conventional binder agents can be employed for binding the above-mentioned leuco dyes and color developers in the thermosensitive coloring layer to the intermediate layer. Specific examples of such binder agents are the same as employed in the above-described intermediate layer.

Further in the present invention, auxiliary additive components which are employed in the conventional thermosensitive recording materials, such as a filler, a thermofusible material (or unguent) and a surface active agent can be employed together with the above-mentioned leuco dyes and color developers.

As the filler, the same fillers as employed in the sub-intermediate layer can be used.

As the thermofusible material, for example, higher fatty acids, esters, amides and metallic salts thereof, waxes, condensation products of aromatic carboxylic acids and amines, benzoic acid phenyl esters, higher straight chain glycols, 3,4-epoxy-dialkyl hexahydrophthalate, higher ketones and other thermofusible organic compounds having melting points ranging from about 50° C. to 200° C. can be employed.

According to the present invention, a protective layer can be overlaid on the thermosensitive coloring layer for the purpose of increasing the thermal head matching properties and improving the preservability of recorded images. When the protective layer is provided, the previously mentioned fillers, binder agents, surface active agents and thermofusible materials (unguent) can be contained in the protective layer.

Other features of this invention will become apparent in the course of the following description of exemplary embodiments, which are given for illustration of the invention and are not intended to be limiting thereof.

EXAMPLE 1

Preparation of Intermediate Layer Coating Liquid (A-1)

A mixture of the following components was dispersed and stirred, whereby an intermediate layer coating liquid (A-1) was prepared:

Liquid (A-1)

| | Parts by Weight |
|---|---|
| Expandable plastic filler (unexpanded) (Trademark "Matsumoto Micro Sphere F—30" made by Matsumoto Yushi-Seiyaku Company, Ltd.) (solid content: 70%) | 20 |
| Electroconductive agent (a) | 1 |

-continued

| | Parts by Weight |
|---|---|
| (aliphatic quaternary ammonium substituted polystyrene; Trademark "Chemistat 6300" made by Sanyo Chemical Industries, Ltd.) | |
| 10% aqueous solution of polyvinyl alcohol | 20 |
| Water | 59 |

The above intermediate layer coating liquid (A-1) was coated on a sheet of commercially available high quality paper with a deposition amount of about 3 g/m$^2$ on a dry basis in an unexpanded state. The coated sheet was dried and heated in a thermostat at about 140° C. for about 2 minutes to expand the expandable plastic filler contained in the intermediate layer coating liquid (A-1), so that an intermediate layer was formed on the support.

Preparation of Thermosensitive Coloring Layer Coating Liquid (B-1)

Liquid (C-1) and Liquid (D-1) were prepared by grinding and dispersing the following respective mixtures separately in a ball mill until the volume mean diameter of the dispersed particles reached about 1.5 μm:

Liquid (C-1)

| | Parts by Weight |
|---|---|
| 3-(N—cyclohexyl-N—methyl)amino-6-methyl-7-anilinofluoran | 20 |
| 10% aqueous solution of polyvinyl alcohol | 20 |
| Water | 60 |

Liquid (D-1)

| | Parts by Weight |
|---|---|
| Benzyl p-hydroxybenzoate | 20 |
| Calcium carbonate | 10 |
| 10% aqueous solution of polyvinyl alcohol | 30 |
| Water | 40 |

A mixture of Liquid (C-1) and Liquid (D-1) with a mixing ratio of 1:3 by weight was stirred, so that a thermosensitive coloring layer coating liquid (B-1) was prepared.

The thermosensitive coloring layer coating liquid (B-1) was coated onto the surface of the above-prepared intermediate layer with a deposition amount of about 3 g/m$^2$ on a dry basis, and the coated liquid was dried to form a thermosensitive coloring layer, whereby a thermosensitive recording material No. 1 according to the present invention was prepared.

EXAMPLE 2

Example 1 was repeated except that the intermediate layer was subjected to supercalendering at a speed of 10 m/min., with application of a pressure of 30 kg/cm$^2$, prior to the formation of the thermosensitive coloring layer thereon, whereby a thermosensitive recording material No. 2 according to the present invention was prepared.

EXAMPLE 3

Preparation of First Intermediate Layer Coating Liquid (A-1)

A mixture of the following components was dispersed and stirred, whereby a first intermediate layer coating liquid (A-1) was prepared:

Liquid A-1

| | Parts by Weight |
|---|---|
| Expandable plastic filler (unexpanded) (Trademark "Matsumoto Micro Sphere F—30" made by Matsumoto Yushi-Seiyaku Company, Ltd.) (solid content: 70%) | 20 |
| Electroconductive agent (a) (aliphatic quaternary ammonium substituted polystyrene; Trademark "Chemistat 6300" made by Sanyo Chemical Industries, Ltd.) | 1 |
| 10% aqueous solution of polyvinyl alcohol | 20 |
| Water | 59 |

The above first intermediate layer coating liquid (A-1) was coated on a sheet of commercially available high quality paper with a deposition amount of about 3 g/m$^2$ on a dry basis in an unexpanded state. The coated sheet was dried and heated in a thermostat at about 140° C. for about 2 minutes to expand the expandable plastic filler contained in the first intermediate layer coating liquid (A-1), so that a first intermediate layer was formed on the support.

Preparation of Second Intermediate Layer Coating Liquid (A-2)

A mixture of the following components was dispersed and stirred, whereby a second intermediate layer coating liquid (A-2) was prepared:

Liquid (A-2)

| | Parts by Weight |
|---|---|
| Finely-divided particles of calcium carbonate coating silica (Trademark "P—832" made by Mizusawa Industrial Chemicals, Ltd.) | 15 |
| 50% styrene - butadiene copolymer latex (Trademark "Almatex E-3450" made by Mitsui Toatsu Chemicals, Inc.) | 30 |
| Water | 55 |

The above second intermediate layer coating liquid (A-2) was coated on the above first intermediate layer with a deposition amount of about 2 g/m$^2$ on a dry basis and then dried, so that a second intermediate layer was formed on the first intermediate layer.

The same thermosensitive coloring layer coating liquid (B-1) as prepared in Example 1 was coated on the surface of the above second intermediate layer with a deposition amount of about 3 g/m$^2$ on a dry basis, and the coated liquid was dried to form a thermosensitive coloring layer on the second intermediate layer, whereby a thermosensitive recording material No. 3 according to the present invention was prepared.

EXAMPLE 4

Example 3 was repeated except that the second intermediate layer was subjected to supercalendering at a speed of 10 m/min., with application of a pressure of 30 kg/cm$^2$, prior to the formation of the thermosensitive coloring layer thereon, whereby a thermosensitive recording material No. 4 according to the present invention was prepared.

EXAMPLE 5

Example 3 was repeated except that the second intermediate layer coating liquid (A-2) employed in Example 3 was replaced by a second intermediate layer coating liquid (A-3), with the following formulation, whereby a thermosensitive recording material No. 5 according to the present invention was prepared.

Liquid (A-3)

| | Parts by Weight |
|---|---|
| Finely-divided particles of calcium carbonate coating silica (Trademark "P—832" made by Mizusawa Industrial Chemicals, Ltd.) | 15 |
| Electroconductive agent (a) (aliphatic quaternay ammonium substituted polystyrene; Trademark "Chemistat 6300" made by Sanyo Chemical Industries, Ltd.) | 1 |
| 50% styrene - butadiene copolymer latex (Trademark "Almatex E-3450" made by Mitsui Toatsu Chemicals, Inc.) | 30 |
| Water | 55 |

EXAMPLE 6

Example 5 was repeated except that the second intermediate layer was subjected to supercalendering at a speed of 10 m/min., with application of a pressure of 30 kg/cm$^2$, prior to the formation of the thermosensitive coloring layer thereon, whereby a thermosensitive recording material No. 6 according to the present invention was prepared.

COMPARATIVE EXAMPLE 1

Example 1 was repeated except that the intermediate layer coating liquid A-1) employed in Example 1 was replaced by an intermediate layer coating liquid (A-4) with the following formulation, whereby a comparative thermosensitive recording material No. 1 was prepared.

Liquid (A-4)

| | Parts by Weight |
|---|---|
| Expandable plastic filler (unexpanded) (Trademark "Matsumoto Micro Sphere F—30" made by Matsumoto Yushi-Seiyaku Company, Ltd.) (solid content: 70%) | 20 |
| 10% aqueous solution of polyvinyl alcohol | 20 |
| Water | 60 |

COMPARATIVE EXAMPLE 2

Example 1 was repeated except that the intermediate layer coating liquid (A-1) employed in Example 1 was replaced by the intermediate layer coating liquid (A-4) employed in Comparative Example 1, and the intermediate layer was subjected to supercalendering at a speed of 10 m/min., with application of a pressure of 30 kg/cm$^2$, prior to the formation of the thermosensitive coloring layer thereon, whereby a comparative thermosensitive recording material No. 2 was prepared.

COMPARATIVE EXAMPLE 3

Example 3 was repeated except that the first intermediate layer coating liquid (A-1) employed in Example 3 was replaced by the intermediate layer coating liquid (A-4) employed in Comparative Example 1, whereby a comparative thermosensitive recording material No. 3 was prepared.

COMPARATIVE EXAMPLE 4

Example 4 was repeated except that the first intermediate layer coating liquid (A-1) employed in Example 4 was replaced by the intermediate layer coating liquid (A-4) employed in Comparative Example 1, whereby a comparative thermosensitive recording material No. 4 was prepared.

EXAMPLE 7

Preparation of First Intermediate Layer Coating Liquid (A-4)

A mixture of the following components was dispersed and stirred, whereby a first intermediate layer coating liquid (A-4) was prepared:

Liquid (A-4)

| | Parts by Weight |
|---|---|
| Expandable plastic filler (unexpanded) (Trademark "Matsumoto Micro Sphere F—30" made by Matsumoto Yushi-Seiyaku Company, Ltd.) (solid content: 70%) | 20 |
| 10% aqueous solution of polyvinyl alcohol | 20 |
| Water | 60 |

The above first intermediate layer coating liquid (A-4) was coated on a sheet of commercially available high quality paper with a deposition amount of about 3 g/m$^2$ on a dry basis in an unexpanded state. The coated sheet was dried and heated in a thermostat at about 140° C. for about 2 minutes to expand the expandable plastic filler contained in the first intermediate layer coating liquid (A-4), so that a first intermediate layer was formed on the support.

Preparation of Second Intermediate Layer Coating Liquid (A-2)

A mixture of the following components was dispersed and stirred, whereby a second intermediate layer coating liquid (A-2) was prepared:

Liquid (A-2)

| | Parts by Weight |
|---|---|
| Finely-divided particles of calcium carbonate coating silica (Trademark "P—832" made by Mizusawa Industrial Chemicals, Ltd.) | 15 |

-continued

| | Parts by Weight |
|---|---|
| 50% styrene - butadiene copolymer latex (Trademark "Almatex E-3450" made by Mitsui Toatsu Chemicals, Inc.) | 30 |
| Water | 55 |

The above second intermediate layer coating liquid (A-2) was coated on the above first intermediate layer with a deposition amount of about 2 g/m$^2$ on a dry basis and then dried, so that a second intermediate layer was formed on the first intermediate layer.

Preparation of Thermosensitive Coloring Layer Coating Liquid (B-2)

100 parts by weight of the thermosensitive coloring layer coating liquid (B-1) employed in Example 1 and 1 part by weight of the electroconductive agent (a) in the formulation of the intermediate layer coating liquid (A-1) employed in Example 1 were dispersed, so that a thermosensitive coloring layer coating liquid (B-2) was prepared.

The thus prepared thermosensitive coloring layer coating liquid (B-2) was coated on the surface of the above-prepared second intermediate layer with a deposition amount of about 3 g/m$^2$ on a dry basis, and the coated liquid was dried to form a thermosensitive coloring layer, whereby a thermosensitive recording material No. 7 according to the present invention was prepared.

EXAMPLE 8

Example 8 was repeated except that the second intermediate layer was subjected to supercalendering at a speed of 10 m/min., with application of a pressure of 30 kg/cm$^2$, prior to the formation of the thermosensitive coloring layer thereon, whereby a thermosensitive recording material No. 8 according to the present invention was prepared.

EXAMPLE 9

Example 1 was repeated except that the intermediate layer coating liquid (A-1) employed in Example 1 was replaced by an intermediate layer coating liquid (A-5) with the following formulation, whereby a thermosensitive recording material No. 9 according to the present invention was prepared.

Liquid (A-5)

| | Parts by Weight |
|---|---|
| Expandable plastic filler (unexpanded) (Trademark "Matsumoto Micro Sphere F—30" made by Matsumoto Yushi-Seiyaku Company, Ltd.) (solid content: 70%) | 20 |
| Electroconductive agent (b) (zinc oxide) | 1 |
| 10% aqueous solution of polyvinyl alcohol | 20 |
| Water | 59 |

EXAMPLE 10

Example 9 was repeated except that the intermediate layer was subjected to supercalendering at a speed of 10 m/min., under application of a pressure of 30 kg/cm$^2$, prior to the formation of the thermosensitive coloring layer thereon, whereby a thermosensitive recording material No. 10 according to the present invention was prepared.

COMPARATIVE EXAMPLE 5

The thermosensitive coloring layer coating liquid (B-1) prepared in Example 1 was coated on a sheet of commercially available high quality paper with a deposition amount of about 3 g/m$^2$ on a dry basis, whereby a comparative thermosensitive recording material No. 5 was prepared.

EXAMPLE 11

Preparation of First Intermediate Layer Coating Liquid (A-4)

A mixture of the following components was dispersed and stirred, whereby a first intermediate layer coating liquid (A-4) was prepared:

Liquid (A-4)

| | Parts by Weight |
|---|---|
| Expandable plastic filler (unexpanded) (Trademark "Matsumoto Micro Sphere F—30" made by Matsumoto Yushi-Seiyaku Company, Ltd.) (solid content: 70%) | 20 |
| 10% aqueous solution of polyvinyl alcohol | 20 |
| Water | 60 |

The above first intermediate layer coating liquid (A-4) was coated on a sheet of commercially available high quality paper in a deposition amount of about 3 g/m$^2$ on a dry basis in an unexpanded state. The coated sheet was dried and heated in a thermostat at about 140° C. for about 2 minutes to expand the expandable plastic filler contained in the intermediate layer coating liquid (A-4), so that a first intermediate layer was formed on the support.

Preparation of Second Intermediate Layer Coating Liquid (A-3)

A mixture of the following components was dispersed and stirred, whereby a second intermediate layer coating liquid (A-3) was prepared:

Liquid (A-3)

| | Parts by Weight |
|---|---|
| Finely-divided particles of calcium carbonate coating silica (Trademark "P—832" made by Mizusawa Industrial Chemicals, Ltd.) | 15 |
| Electroconductive agent (a) (aliphatic quaternary ammonium substituted polystyrene; Trademark "Chemistat 6300" made by Sanyo Chemical Industries, Ltd.) | 1 |
| 50% styrene - butadiene copolymer latex (Trademark "Almatex E-3450" made by Mitsui Toatsu Chemicals, Inc.) | 30 |
| Water | 55 |

The above second intermediate layer coating liquid (A-3) was coated on the first intermediate layer with a deposition amount of about 2 g/m$^2$ on a dry basis and then dried, so that a second intermediate layer was formed on the first intermediate layer.

The thermosensitive coloring layer coating liquid (B-1) prepared in Example 1 was coated on the surface of the above-prepared second intermediate layer with a deposition amount of about 3 g/m$^2$ on a dry basis, and the coated liquid was dried to form a thermosensitive coloring layer, whereby a thermosensitive recording material No. 11 according to the present invention was prepared.

EXAMPLE 12

Example 11 was repeated except that the second intermediate layer was subjected to supercalendering at a speed of 10 m/min., with application of a pressure of 30 kg/cm$^2$, prior to the formation of the thermosensitive coloring layer thereon, whereby a thermosensitive recording material No. 12 according to the present invention was prepared.

The thermosensitive recording materials No. 1 through No. 12 according to the present invention and the comparative thermosensitive recording materials No. 1 through No. 5 were subjected to supercalendering at a speed of 10 m/min., with application of a pressure of 5 kg/cm$^2$.

Each of the above thermosensitive recording material was subjected to an image formation test to measure the dynamic thermal coloring density and to evaluate the dot reproduction of the recorded images using a commercially available facsimile apparatus (Trademark "Rifax 131" made by Ricoh Company Ltd.).

The above-described image formation test was carried out by copying the facsimile test chart No. 1 (designated by The Institute of Image Electronics Engineer of Japan) on each of the above thermosensitive recording materials at 22° C. and 65% RH.

The dynamic thermal coloring density of the solid image portion of the obtained images was measured by use of a Macbeth densitometer RD-514 with a filter Wratten-106.

Each of the above thermosensitive recording materials was subjected to a paper discharge test using the same commercially available facsimile apparatus (Trademark "Rifax 131" made by Ricoh Company Ltd.) as employed in the image formation test to see the presence of troubles with respect to the discharging of printed thermosensitive recording materials. This paper discharge test was carried out by continuously making 30 copies of the above mentioned facsimile test chart No. 1, using each of the above thermosensitive recording materials at 5° C. and 30% RH.

The results are shown in Table 1.

TABLE 1

| Example No. | Thermosensitive Recording Material | First Intermediate Layer: Present/Absent | First Intermediate Layer: Electroconductive Agent | Second Intermediate Layer: Present/Absent | Second Intermediate Layer: Electroconductive Agent | Thermosensitive Coloring Layer: Electroconductive Agent | Calendering of First Intermediate Layer (or Second Intermediate Layer): Calendered/not calendered | Suitability*1 for Calendering | Dynamic Thermal Coloring Density | Image*2 Uniformity | Paper*3 Discharging Performance |
|---|---|---|---|---|---|---|---|---|---|---|---|
| Example 1 | No. 1 | Present | (a) | Absent | — | Absent | Not calendered | — | 1.26 | Δ | 0 |
| Example 2 | No. 2 | Present | (a) | Absent | — | Absent | Calendered | 0 | 1.31 | 0 | 0 |
| Example 1 | No. 3 | Present | (a) | Present | Absent | Absent | Not calendered | — | 1.31 | 0 | 0 |
| Example 4 | No. 4 | Present | (a) | Present | Absent | Absent | Calendered | 0 | 1.35 | | 0 |
| Example 5 | No. 5 | Present | (a) | Present | (a) | Absent | Not calendered | — | 1.31 | 0 | 0 |
| Example 6 | No. 6 | Present | (a) | Present | (a) | Absent | Calendered | 0 | 1.35 | | 0 |
| Example 7 | No. 7 | Present | Absnet | Present | Absent | (a) | Not calendered | — | 1.28 | 0 | |
| Example 8 | No. 8 | Present | Absent | Present | Absent | (a) | Calendered | X | 1.33 | 0 | |
| Example 9 | No. 9 | Present | (b) | Absent | — | Absent | Not calendered | — | 1.25 | Δ | 0 |
| Example 10 | No. 10 | Present | (b) | Absent | — | Absent | Calendered | 0 | 1.31 | 0 | 0 |
| Example 11 | No. 11 | Present | Absent | Present | (a) | Absent | Not calendered | — | 1.30 | 0 | 0 |
| Example 12 | No. 12 | Present | Absent | Present | (a) | Absent | Calendered | 0 | 1.33 | | 0 |
| Comparative Example 1 | No. 1 | Present | Absent | Absent | — | Absent | Not calendered | — | 1.25 | Δ | X |
| Comparative Example 2 | No. 2 | Present | Absent | Absent | — | Absent | Calendered | X | 1.30 | 0 | X |
| Comparative Example 3 | No. 3 | Present | Absent | Present | Absent | Absent | Not calendered | — | 1.28 | 0 | X |

TABLE 1-continued

| Example No. | Thermosensitive Recording Material | First Intermediate Layer Present/Absent | First Intermediate Layer Electroconductive Agent | Second Intermediate Layer Present/Absent | Second Intermediate Layer Electroconductive Agent | Thermosensitive Coloring Layer Electroconductive Agent | Calendering of First Intermediate Layer (or Second Intermediate Layer) Calendered/not calendered | Calendering of First Intermediate Layer (or Second Intermediate Layer) Suitability*1 for Calendering | Dynamic Thermal Coloring Density | Image*2 Uniformity | Paper*3 Discharging Performance |
|---|---|---|---|---|---|---|---|---|---|---|---|
| Comparative Example 4 | No. 4 | Present | Absent | Present | Absent | Absent | Calendered | X | 1.34 | 0 | X |
| Comparative Example 5 | No. 5 | Absent | — | Absent | — | Absent | — | — | 0.53 | X | 0 |

In Table 1, the suitability for calendering of the intermediate layer (*1) is judged by checking whether or not the thermosensitive recording material was attached to the pressure application roller. The mark ○ denotes "suitable" and the mark × denotes "unsuitable".

The image uniformity (*2) is judged from the dot reproduction of printed images. The mark ◎ ○△ and × respectively denote "excellent", "good", "fair" and "poor".

The paper discharging performance (*3) is judged from the presence of troubles with respect to the discharging of the printed thermosensitive recording materials by the paper discharging test. The mark ○ denotes that no troubles occurred during the paper discharging test; the mark △ denotes that the trouble occurred once or twice during the test; and the mark × that the trouble occurred three times or more during the test.

The results shown in Table 1 indicate that the thermosensitive recording materials according to the present invention are capable of yielding uniform images without any paper discharging problem, and exhibit high dynamic thermal coloring sensitivity.

In particular, the thermosensitive recording materials in which the intermediate layer comprises the electroconductive agent are free from the problem that the recording materials are attached to the metallic pressure application rollers in the course of the calendering process and no sparking takes place. Further, the suitability for calendering of the intermediate layer is superior because the layer is not attached to the surface of the pressure application roller during the calendering process.

The thermosensitive recording materials according to the present invention are not so easily electrostatically charged that the recording materials can be manufactured steadily and that the discharging problems of the materials hardly occur in practical use in the thermal printing apparatus.

What is claimed is:

1. A thermosensitive recording material comprising a support, an intermediate layer comprising an expanded plastic filler, formed on said support, and a thermosensitive coloring layer formed on said intermediate layer, with an electroconductive agent being contained in an effective amount in at least said intermediate layer.

2. The thermosensitive recording material as claimed in claim 1, wherein said electroconductive agent is also contained in said thermosensitive coloring layer.

3. The thermosensitive recording material as claimed in claim 1, wherein said intermediate layer comprises a first intermediate layer comprising said expanded plastic filler formed on said support, and a second intermediate layer comprising an organic and/or inorganic filler and a resin capable of forming and emulsion with water and/or a water-based emulsion type resin, formed on said second intermediate layer wherein said electroconductive agent is contained in at least one of said first intermediate layer and said second intermediate layer.

4. The thermosensitive recording material as claimed in claim 3, wherein said electroconductive agent is also contained in said thermosensitive coloring layer.

5. The thermosensitive recording material as claimed in claim 3, wherein said electroconductive agent is contained in both of said first intermediate layer and said second intermediate layer.

6. The thermosensitive recording material as claimed in claim 3, wherein the amount of said electroconductive agent is 10 wt. % or less of the entire solid components contained in each layer which contains said electroconductive agent.

7. The thermosensitive recording material as claimed in claim 3, wherein said second intermediate layer is subjected to calendering prior to the formation of said thermosensitive coloring layer thereon.

8. The thermosensitive recording material as claimed in claim 1, wherein the amount of said electroconductive agent is 10 wt. % or less of the entire solid components contained in each layer which contains said electroconductive agent.

9. The thermosensitive recording material as claimed in claim 1, wherein said electroconductive agent is selected from the group consisting of inorganic salts, organic salts, electroconductive metallic oxides, nonionic antistatic agents, anionic antistatic agents, cationic antistatic agents, amphoteric antistatic agents, and polymeric antistatic agents.

10. The thermosensitive recording material as claimed in claim 9, wherein said electroconductive agent is an inorganic salt selected from the group consisting of sodium chloride, potassium chloride, magnesium chloride, ammonium chloride, lithium chloride, aluminum chloride, zinc chloride, potassium bromide, zinc bromide, zinc phosphate, and zinc acetate.

11. The thermosensitive recording material as claimed in claim 9, wherein said electroconductive agent is an organic salt selected from the group consisting of potassium formate and sodium oxalate.

12. The thermosensitive recording material as claimed in claim 9, wherein said electroconductive agent is an electroconductive metallic oxide selected from the group consisting of zinc oxide and tin oxide.

13. The thermosensitive recording material as claimed in claim 9, wherein said electroconductive agent is a nonionic antistatic agent selected from the group consisting of polyoxyethylene alkylamine, polyoxyethylene alkylamide, polyoxyethylene alkyl ether, polyoxyethylene alkyl phenyl ether, glycerol fatty acid ester, and sorbitan fatty acid ester.

14. The thermosensitive recording material as claimed in claim 9, wherein said electroconductive agent is an anionic antistatic agent selected from the group consisting of alkylsulfonate, alkylbenzenesulfonate alkylsulfate, alkyl phosphate, polyacrylic acid salt, polymethacrylate salt, and polystyrene sulfonate.

15. The thermosensitive recording material as claimed in claim 9, wherein said electroconductive agent is a cationic antistatic agent selected from the group consisting of quaternary ammonium chloride, quaternary ammonium sulfate, quaternary ammonium nitrate and methylpyridinium salt.

16. The thermosensitive recording material as claimed in claim 9, wherein said electroconductive agent is an amphoteric antistatic agent selected from the group consisting of alkyl betaine, alkyl imidazoline and alkyl alanine.

17. The thermosensitive recording material as claimed in claim 9, wherein said electroconductive agent is a polymeric antistatic agent selected from the group consisting of polyvinyl benzyl cation, polyacrylic acid type cation and polystyrene cation.

18. The thermosensitive recording material as claimed in claim 1, wherein said intermediate layer is subjected to calendering prior to the formation of said thermosensitive coloring layer thereon.

* * * * *

UNITED STATES PATENT AND TRADEMARK OFFICE

CERTIFICATE OF CORRECTION

PATENT NO. : 4,895,828

DATED : JANUARY 23, 1990

INVENTOR(S) : HIROSHI YAGUCHI ET AL

It is certified that error appears in the above-identified patent and that said Letters Patent is hereby corrected as shown below:

Column 6, line 63, "(d)" should read --(f)--;
line 67, "(e)" should read --(g)--.

Column 7, line 1, "(f)" should read --(h)--.

Column 8, line 2, "comprises s" should read --comprises as--;
line 18, delete "Ctystal", insert --Crystal--.

Column 13, line 48, "liquid A-1)" should read --liquid (A-1)--.

Table 1, third row of Example Nos., "Example No. 1" should read --Example No. 3--;
Example No. 7, fourth column, delete "Absnet", insert --Absent--;

Table 1, "Image*2 Uniformity" column, Example 4, insert --◎--;
"Image*2 Uniformity" column, Example 6, insert --◎--;
"Image*2 Uniformity" column, Example 12, insert --◎--.

Column 19, line 27, delete "◎○△", insert --◎, ○, △--;

UNITED STATES PATENT AND TRADEMARK OFFICE

CERTIFICATE OF CORRECTION

PATENT NO. : 4,895,828

DATED : January 23, 1990

INVENTOR(S) : Hiroshi Yaguchi, et al

It is certified that error appears in the above-indentified patent and that said Letters Patent is hereby corrected as shown below:

Column 19, line 36, "mark X that" should read --mark X denotes that--.

Signed and Sealed this

Second Day of November, 1993

Bruce Lehman

*Attest:*

BRUCE LEHMAN

*Attesting Officer*

*Commissioner of Patents and Trademarks*